US005911488A

United States Patent [19]

Geromini et al.

[11] Patent Number: 5,911,488

[45] Date of Patent: Jun. 15, 1999

[54] METHOD AND APPARATUS FOR PREVENTING AGGLOMERATION

[75] Inventors: Osvaldo Geromini, Valeyres/Rances; Werner Pfaller, Orbe; Paul-Henri Poget, Bretonnieres, all of Switzerland

[73] Assignee: Nestec S.A., Vevey, Switzerland

[21] Appl. No.: 08/695,262

[22] Filed: Aug. 9, 1996

[30] Foreign Application Priority Data

Sep. 6, 1995 [EP] European Pat. Off. ..... 95202407

[51] Int. Cl.[6] ..... F26B 3/00

[52] U.S. Cl. ..... 34/508; 34/365; 34/430

[58] Field of Search ..... 34/181, 191, 216, 34/225, 233, 232, 359, 360, 365, 366, 429, 430, 508, 577, 579, 586

[56] References Cited

U.S. PATENT DOCUMENTS

| | | | |
|---|---|---|---|
| 2,974,419 | 3/1961 | Hauk | 34/10 |
| 3,060,590 | 10/1962 | Brown | 34/20 |
| 3,229,377 | 1/1966 | Hoyt | 34/10 |
| 3,262,217 | 7/1966 | Brown | 34/57 |
| 3,372,489 | 3/1968 | Brown | 34/57 |
| 3,794,099 | 2/1974 | Ganiaris | 159/48 R |
| 4,071,960 | 2/1978 | Bowles | 34/57 |
| 4,109,394 | 8/1978 | Hoyt | 34/57 |
| 4,169,322 | 10/1979 | Buske | 34/57 |
| 4,201,499 | 5/1980 | Buske et al. | 406/75 |
| 4,910,880 | 3/1990 | Cole | 34/10 |
| 5,370,898 | 12/1994 | Zussman | 426/615 |
| 5,651,191 | 7/1997 | Walunas et al. | 34/236 |

FOREIGN PATENT DOCUMENTS

| | | |
|---|---|---|
| 0 407 073 | 1/1991 | European Pat. Off. . |
| 0 481 799 | 10/1991 | European Pat. Off. . |
| 2 049 899 | 5/1979 | United Kingdom . |

OTHER PUBLICATIONS

Chemical Engineering—Chemical Apparatus & Plants: 631, Nov. 11, 1990 Particle Attrition; Opposing Jets; Nozzle Gas Velocity; Particle Breakage (Abstract only).

Int. J. Multiph. Flow (UK), vol. 19, No. 6, pp. 1159–1161, Dec. 1993, "Differentiation Between Jetting And Bubling in Fluidized Beds" (Abstract only).

*Primary Examiner*—Henry Bennett
*Assistant Examiner*—Pamela A. Wilson
*Attorney, Agent, or Firm*—Pennie & Edmonds LLP

[57] ABSTRACT

The present invention relates to a method for preventing agglomeration while drying sticky particles in a fluid bed. The method comprises supplying sticky particles to an upper surface of a perforated conveyor and advancing said sticky particles through the fluid bed, supplying drying air flow substantially upwards through the perforated conveyor to the sticky particles on it. While drying the particles exposing them substantially, from above, to a pulsing air flow so that they are caused to move and to break up agglomerates of sticky particles. This is done while controlling drying and pulsing air flow, pulsation, and drying air temperature. The invention also relates to a fluid bed preventing agglomeration while drying sticky particles.

32 Claims, 2 Drawing Sheets

METHOD AND APPARATUS FOR PREVENTING AGGLOMERATION

TECHNICAL FIELD

The present invention relates to a method for preventing agglomeration while drying sticky particles such as cereal dough particles, dough for chip products, or pasta dough particles in a fluid bed. This method comprises application of pulsing gas onto the sticky particles while drying air is blown up through the sticky particles. The invention relates as well to an apparatus for carrying out such a method.

BACKGROUND ART

Drying of sticky particles is well known in the production of cereal. In such a production the cereal dough may first be extruded, rolled out to the appropriate thickness and cut into pieces or particles. The particles are then dried before they are puffed at a high temperature and subsequently coated with flavoring or sweeteners. At the drying step described here the particles of un-baked or wet dough will be sticky.

Drying sticky particles such as the pieces of cereal dough mentioned above or other related products e.g. dough for chip products, pasta dough etc. is difficult because the particles tend to stick together and form agglomerates, i.e. bigger lumps of dough. Once an agglomerate is formed, a non-uniform drying of the dough will take place. Furthermore, the shape of particles or chips will be ruined if dough particles are allowed to stick together during the drying process. This is unsatisfactory in the production of quality products.

Difficulties are also experienced when dough particles or chips having a high moisture content, e.g. 15 to 20% $H_2O$, are dried at a high temperature, e.g. about 180° C., and contact is allowed between the particles while the drying takes place. In order to avoid this and to prevent cracks in the surface of the particles, they must be dried at lower temperatures. Conventionally, the drying operation of such particles has therefore been carried out in a number of steps.

Different processes are known for carrying out the drying of sticky particles. The first drying step may for example be drying in a tumbler dryer where the temperature is kept relatively low, e.g. about 100° C. The particles or chips are only partly dried in this first drying step. Additional drying steps at higher temperatures may then be performed in tumbler dryers, fluid beds, etc.

The tumble drying required for drying of cereal dough in a production line usually is of large dimensions. For example, the dryer drum can be from 5 to 6 m long and about 2.5 m in diameter.

In the fluid bed only a thin layer, for example about 5 cm, of particles can be advanced and dried at a time. If the layer is too thick the sticky particles will tend to form agglomerates and will not be uniformly dried. The agglomeration of the particles hence limits the capacity of the fluid bed.

The above described multi-step drying processes, consequently are disadvantageous as they are both time and energy consuming.

An attempt at having a number of different drying processes in one apparatus is disclosed in U.S. Pat. No. 4,910,880. The apparatus described therein employs drying gases flowing up and down and which pass through a foraminous conveyor advancing the product to be dried. However, this patent does not describe any attempt to prevent agglomeration of sticky particles.

SUMMARY OF THE INVENTION

The aim of the present invention is to provide a one step method for drying sticky particles or chips and to prevent agglomeration thereof. Furthermore, it is possible with the present invention to dry a large quantity of sticky particles while retaining good surface properties. Surprisingly, drying of a 10 to 20 cm thick layer of sticky particles has been carried out substantially without agglomeration of the particles. The thickness which can be dried satisfactorily depends on the particles' moisture content. Tests have shown, that the throughput of a conventional fluid bed providing about 80 kg per hour can be raised from 150 to 180 kg per hour when the fluid bed is adapted in accordance with the invention. It has also, surprisingly, been observed that it is possible to avoid agglomeration and obtain a good product finish by exposing the sticky particles to a pulsing air flow from above while blowing drying air from below through a perforated conveyor in a fluid bed.

The present invention further provides a compact and well balanced apparatus. Though the apparatus employs pulsing air and optionally also other means of vibration of the sticky particles, the invention provides means for minimizing the vibrations transmitted to the surroundings.

In a first aspect, the present invention relates to a method for preventing agglomeration while drying sticky particles in a fluid bed. This method distinguishes itself by comprising

- supplying sticky particles to an upper surface of a perforated conveyor and advancing said sticky particles through the fluid bed,
- supplying drying air flow substantially upwards through the perforated conveyor to the sticky particle on it,
- exposing substantially from above the sticky particles to a pulsing air flow so that they are caused to move and to break up agglomerates of sticky particles, and
- controlling the supply of the drying and pulsing air flow, the pulsation, and the drying air temperature.

The sticky particles may be dried with hot air or other hot gases allowed in food production. The temperature of the drying air preferably ranges from 100° C. to 180° C., advantageously about 120° C. The pulsation may be generated by a pulsing gas or air flow having room temperature or alternatively heated or cooled.

It is preferred that the velocity of the pulsing air is from 10 to 15 times as high as the velocity of the drying air, preferably about 13 times as high. Beneficially, the velocity of the drying air is about 1.5 m/s while the velocity of the pulsing air is about 20 m/s.

The method may conveniently be carried out with sticky particles having a bulk density in the range from 350 g/l to 450 g/l, preferably about 400 g/l. The types of sticky particles that can be processed by the method of the invention typically include, a cereal dough comprising wheat, sugar, malt and water; or rice, sugar and water.

The bigger particles require a longer drying time, and the risk that they will agglomerate is higher. With the method according to the invention sticky particles of the following size may advantageously be dried: length in the range of 10 mm to 20 mm, preferably from 12 mm to 17 mm, width in the range of 10 mm to 20 mm, preferably of 12 mm to 17 mm, and thickness in the range of 1 mm to 2 mm, preferably about 1.5 mm.

In order to prevent agglomeration, the sticky particles should preferably be moved at short intervals so that they do not have enough time to stick together. The perforated conveyor is therefore preferably a vibrating tray or table which conveyor adds to the relative movement between the sticky particles.

The pulsing air flow may conveniently comprise a plurality of substantially parallel pulsing air jets. Additionally, a plurality of pulsing air jets may be provided, the direction of which is adapted to the configuration of the fluid bed in order to optimize the configuration of the pulsing air flow, and hence provide substantial turbulence of the sticky particles while they are being dried. The pulsing air jets may advantageously be positioned in a matrix having a plurality of parallel rows of air jets, and wherein the pulsing air jets in one column pulse synchronically. To simplify the supply system the pulsing air jets in one row are preferably connected to a common air supply pipe.

To create sufficient "punch" and thus turbulence between the sticky particles which can break up starting agglomerates it is preferred that the high pressure period of the pulsing air jet lasts for approximately 5 sec. Between a first and a second air pressure, where the first air pressure is higher than the second air pressure, a time sequence of approximately 1 sec. is allowed in order to allow the air supply equipment to recharge and distribute the pressurized air.

In order to obtain a substantially similar disruption of the sticky particles all across the conveyor, the rows of pulsing air jets are preferably displaced parallel relative to each other and transverse to the forward direction of the conveyor. As a result of this, the sticky particles along the substantially whole width of the conveyor are exposed to pulsing air "punches".

Many different pulsation sequences may be applied to the sticky particles, but particularly advantageous is a sequence where the air pulsation from the air jets in the matrix follows a sequence wherein the high pressure period of the jets in the first row is followed by a high pressure period in the last row, followed by a high pressure period of the second row, followed by a high pressure period in the second last row, and so on until all the rows have been activated and the sequence is repeated. In this way, in each sequence pulsation "punches" are applied and shifted from one end of the conveyor to the other, and stepwise moved towards the centre of the conveyor. This gives an equated displacement of the sticky particles on top of the conveyor.

In another aspect the invention relates to a fluid bed for preventing agglomeration while drying sticky particles. This fluid bed comprises an

- inlet means for introducing sticky particles to an upper surface of a perforated conveyor which advances the sticky particles through the fluid bed, and outlet means for discharging the sticky particles from the fluid bed, drying air supply means for supplying drying air substantially upwards through the perforated conveyor to the sticky particles on it,
- pulsing air supply means exposing the sticky particles substantially from above the conveyor to a pulsing air flow so that the particles are caused to move and agglomerates of sticky particles are broken up, and
- control means for controlling the supply of the drying and pulsing air flow, the pulsation, and the drying air temperature.

The sticky particle supply means may e.g. be fluid valves for transporting recently cut-out sticky particles such as dough pieces, by blowing the particles through supply pipes and onto the conveyor. The pulsing air is supplied by supplying means such as a capacity air supply. The capacity air supply builds up an air pressure, which is discharged, after which the capacity is recharged. The pulsing air supply means comprises a plurality of discharge nozzles for supplying a plurality of substantially parallel air jets which are directed towards the upper surface of the perforated conveyor. The jet discharge nozzles may conveniently be positioned in a plane above substantially the whole width of the perforated conveyor, and they may for example be from a matrix or spaced array of nozzles for providing a pulsation with the pulsation sequence characteristics as described above in connection with the method according to the invention.

In a preferred embodiment of the present invention the common air supply pipes are connected to a manifold wherein the supply of pressurised air is controlled by the operation of the manifold. For example, each of the common air supplies may be connected to the manifold via valves, respectively. The operation of the manifold allows pressurised air to be introduced into the supply pipes or cuts off the air supply. Subsequently one or more valves may be opened at a time. However, when a capacity air supply is employed it is necessary to keep all the valves closed during recharging of the capacity. To ease the operation of the manifold it may conveniently be operated by means of a computer running a computer program which includes the instructions to open and close valves according to the desired pulsation sequence.

In a preferred embodiment according to the invention, the sticky particles are advanced on a perforated conveyor in the form of a vibrating tray or table which advances the sticky particles by means of its vibrations. Alternatively, a belt conveyor with openings in the belt may be used.

In a preferred embodiment of the fluid bed according to the invention the velocity of the pulsing air is 10 to 15 times as high as the velocity of the drying air. Advantageously, the velocity of the pulsing air is about 20 m/sec. and the velocity of the drying air is about 1.5 m/sec.

BRIEF DESCRIPTION OF THE DRAWINGS

The invention will now be described in greater detail with reference to the accompanying drawings given by way of example showing a preferred embodiment of the invention and in which.

DETAILED DESCRIPTION OF THE PREFERRED EMBODIMENT

Figure 1:
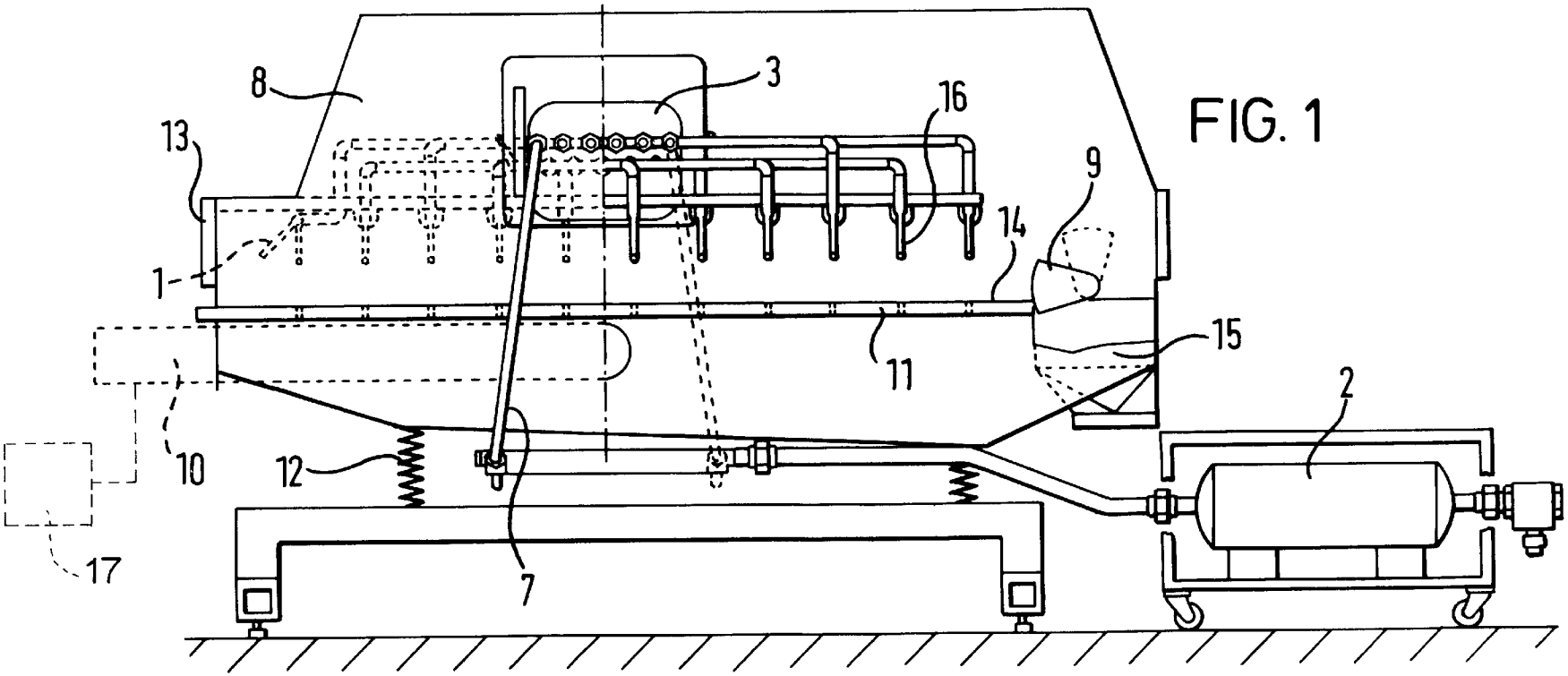
FIG. 1 is a schematic illustration of a side view of the apparatus according to the invention.
Figure 2:
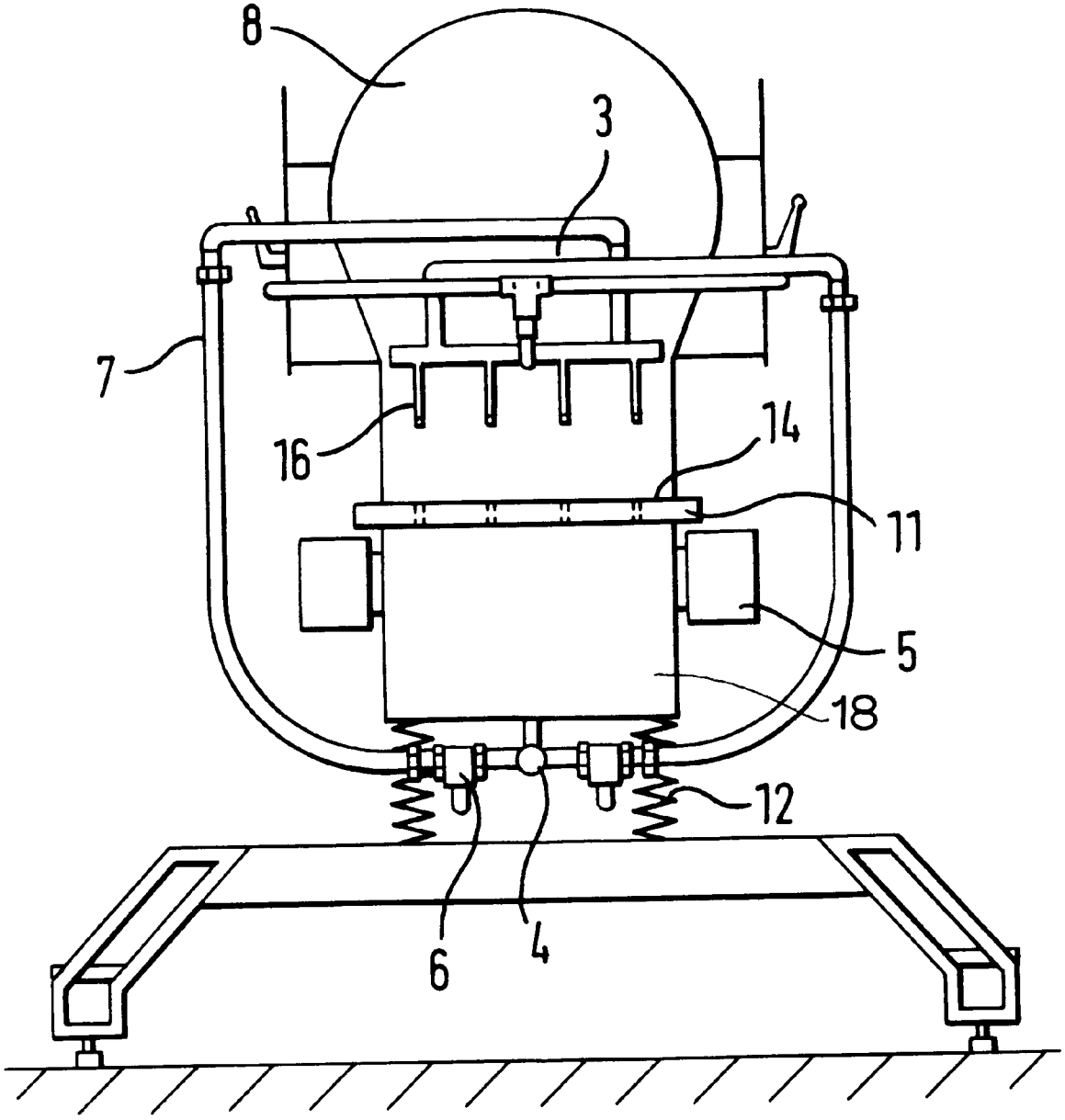
FIG. 2 is a schematic illustration of an end view of the apparatus according to the invention.

FIGS. 1 and 2 show a fluid bed 8 according to the invention. This fluid bed 8 comprises an inlet means 13 for introducing sticky particles to an upper surface 14 of a perforated conveyor 11 which advances the sticky particles through the fluid bed 8. The dough for the sticky particles originates from an extrudate from e.g. a dough cooker or an extruder. The extrudate is cut up into particles. Conveniently, the cut out sticky particles have a length and width in the range of 10 to 20 mm, and a thickness corresponding to that of the extrudate e.g. in the range of 1 to 2 mm. From the cutting zone to the fluid bed 8, the sticky particles are transported via fluid valves and tubes, not shown in the drawings.

The perforated conveyor 11 is preferably a vibrating tray. The movements of the tray advance the sticky particles on upper surface 14 thereof. In the present embodiment of the fluid bed 8, the plate is vibrated by means of vibrators 5 attached to the vibrating table 18. In order to avoid transmission of the vibrations to the surroundings, the fluid bed 8 is positioned on damping members 12. When the sticky particles have been passed the whole way through the fluid bed they are discharged through outlet means 15. The fluid bed further comprises a gate or barrier the adjustment of which causes a regulation of the thickness of the layer of the sticky particles due to the mechanical stopping effect of the barrier.

During transportation through the fluid bed 8 the sticky particles are subjected to drying air supplied by drying air supply means 10, which supplies the drying air in a manner so that the air passes substantially upwards through the perforated conveyor 11. The drying air supplying means may comprise fan and heating means. Means for controlling the temperature of the drying air 17 is connected to the drying air supply means 10. The temperature of the drying air may be controlled by any means known in the art. The heated air is advantageously circulated in order to save energy. There is no requirement to the drying air being pressurized air. The sticky particles are further exposed to pulsing air supplied by pulsing air supply means 3 in a direction substantially downwardly from the supply means 3 which is located above the conveyor 11. This combination of the drying with ascending drying air and descending "punching" pulsing air flow results in relatively rapid drying of the initially sticky particles and prevents agglomerates of particles in the final product. Agglomeration occurring during the passage in the fluid bed 8 will be broken up again by the air flows. In general the air supplied to the sticky particles should be food acceptable.

In this preferred embodiment of the invention, the pulsing air supply means 3 comprises a capacity air supply 2 communicating with a plurality of discharge nozzles 16 in order to provide a plurality of substantially parallel air jets which are directed towards the upper surface 14 of the perforated conveyor 11. The jet discharge nozzles 16 are positioned in a plane above substantially the whole width of the perforated conveyor 11. The capacity air supply 2 builds up a capacity of pressurized air, which, through valves 6, is passed via distribution pipes 7 to the discharge nozzles 16. Each distribution pipe 7 is conveniently connected to a row of discharge nozzles 16. After discharge of the pressurized air, the air pressure builds up again for a subsequent outlet. In order to optimize the configuration of the pulsing air flow and provide substantial turbulence of the sticky particles while they are being dried, a further plurality of pulsing air jets 1 may be provided, the direction of which is adapted to the configuration of the fluid bed.

For an appropriate distribution of the pulsing air the pulsing air supply means further comprises a manifold 4 wherein the supply of pressurized air is controlled by the operation of said manifold 4. For example, each of the distribution pipes 7 is connected to the manifold 4 via the valves 6. Control means are provided for controlling pulsation and supply of air. The control is enabled by operation of the manifold 4 which allows pressurized air to be introduced into the supply distribution pipes 7 or cuts off the air supply. One or more valves 6 may be opened at a time. However, when a capacity air supply is employed, it is necessary to keep all the valves closed during recharging of the capacity. To ease the operation of the manifold 4, it may conveniently be operated by means of a computer running a computer program which includes the instructions to open and close valves according to the desired pulsation sequence. It will be understood that other air supply and control systems may be applied for carrying out the invention. The computer and control systems are well known to one of ordinary skill in the art so that no further detail of such systems need be provided herein.

For the control of the temperature of the drying air and the temperature within the fluid bed, sensors are provided, not shown in the drawings. The pulsing air may be heated, however, this is not a requirement. Tests have shown that the influence of the pulsing air on the temperature is not substantial.

With the embodiment of the fluid bed according to the invention illustrated in FIGS. 1 and 2 the moisture level of the sticky particles will e.g. be reduced to about 8 to 20% $H_2O$. The drying times are e.g. in the range of about 10 to 100 min depending on the throughput, and typically about 30 min.

Tests have shown, that the throughput of the same type of sticky particles with a conventional fluid bed, having a capacity of about 80 kg per hour, could be raised from 150 to 180 kg per hour when the fluid bed is adapted in accordance with the invention.

What is claimed is:

1. A method for preventing agglomeration of sticky particles while drying the sticky particles in a fluid bed, said method comprising:

providing sticky particles upon an upper surface of a perforated conveyor which advances said sticky particles through the fluid bed;

providing a flow of drying air substantially upwards through the perforated conveyor to the sticky particles;

providing a pulsing flow of air downwardly from a position above the sticky particles to move and separate the sticky particles; and controlling the drying and pulsing air flows and the temperature of the drying air to dry the sticky particles and substantially prevent formation of agglomerates thereof.

2. A method according to claim 1, which further comprises vibrating the fluid bed to assist in the fluidization of the sticky particles.

3. A method according to claim 1, which further comprises vibrating the perforated conveyor while the sticky particles are advanced to assist in the separation of the sticky particles.

4. A method according to claim 1, wherein the pulsing air flow is provided by a plurality of substantially parallel air jets which are controlled to provide the air pulses.

5. A method according to claim 4, which further comprises controlling each of the air jets to pulse air between first and second air pressures at time sequences of approximately 1 sec., wherein the first pressure is higher than the second pressure.

6. A method according to claim 5, wherein the first pressure of the pulsing air jet lasts for approximately a 5 sec. period.

7. A method according to claim 4, which further comprises arranging the plurality of air jets in the form of a matrix having a plurality of parallel rows of air jets, and controlling the pulsing of the air jets to synchronically pulse one row of air jets at a time.

8. A method according to claim 7, which further comprises connecting the air jets in a row to a common air supply pipe.

9. A method according to claim 7, which further comprises displacing the rows of air jets parallel relative to each other and transverse to the conveyor so that air pulses are directed to the sticky particles along substantially the whole width of the conveyor.

10. A method according to claim 7, which further comprises controlling the air pulses from the air jets in the matrix to follow a sequence wherein each row of jets is subjected to a first pressure period followed by a second pressure period, with the first pressure period being at a higher pressure than that of the second pressure period, and wherein the higher pressure period of the jets in a first row is followed by the higher pressure period in a last row, followed by the higher pressure period of a second row, followed by the higher pressure period in a second last row, this sequence continuing until all parallel rows of air jets have been activated with a higher pressure period, with the sequence then being repeated.

11. A method according to claim 1, wherein the pulsing air flow is provided by a plurality of air jets which are controlled to provide the air pulses, and wherein the direction of the air jets is adapted to conform to the configuration of the fluid bed and conveyor.

12. A method according to claim 1, which further comprises selecting the temperature of the drying air to be in the range of about 100° C. to 180° C.

13. A method according to claim 1, which further comprises supplying sticky particles having a bulk density in the range of about 350 g/l to 400 g/l.

14. A method according to claim 1, which further comprises supplying sticky particles having a length of about 10 mm to 20 mm, a width of about 10 mm to 20 mm, and a thickness of about 1 mm to 2 mm.

15. A method according to claim 1, which further comprises controlling the velocity of the air pulses to about 10 to 15 times as high as the velocity of the drying air flow.

16. A method according to claim 15, which further comprises controlling the velocity of the air pulses to about 13 times as high as the velocity of the drying air.

17. A method according to claim 1, which further comprises providing the velocity of the air pulses to be about 20 m/sec. and providing the velocity of the drying air flow to be about 1.5 m/sec.

18. A fluid bed for preventing agglomeration of sticky particles while drying the sticky particles, said fluid bed comprising:

inlet means for providing sticky particles upon an upper surface of a perforated conveyor which advances the sticky particles through the fluid bed, and outlet means for discharging the sticky particles from the fluid bed;

drying air supply means for supplying drying air substantially upwards through the perforated conveyor to the sticky particles;

pulsing air supply means for providing a pulsing flow of air downwardly from a position above the sticky particles to move and separate the sticky particles; and control means for controlling the drying and pulsing air flows and the temperature of the drying air to dry the sticky particles and substantially prevent formation of agglomerates thereof.

19. A fluid bed according to claim 18, further comprising a vibrator for vibrating the fluid bed.

20. A fluid bed according to claim 18, further comprising a vibrator for vibrating the perforated conveyor.

21. A fluid bed according to claim 18, wherein the pulsing air supply means comprises a plurality of discharge nozzles for supplying a plurality of substantially parallel pulsing air jets.

22. A fluid bed according to claim 21, wherein the discharge nozzles form a matrix having a plurality of parallel rows, and wherein the pulsing air jets of the discharge nozzles in one column pulse synchronically.

23. A fluid bed according to claim 22, wherein the discharge nozzles in a row are connected to a common air supply pipe.

24. A fluid bed according to claim 23, wherein the common air supply pipes are connected to a manifold and wherein the supply of air is controlled by the operation of said manifold.

25. A fluid bed according to claim 24, wherein the operation of the manifold is carried out by running a computer program by means of a computer.

26. A fluid bed according to claim 21, wherein the rows of discharge nozzles are displaced parallel relative to each other and transverse to the advancing direction of the conveyor so that the sticky particles along substantially the whole width of the conveyor are exposed to pulsing air.

27. A fluid bed according to claim 18, wherein air supply means comprises a plurality of discharge nozzles supplying pulsing air jets the direction of which is adapted to the configuration of the fluid bed.

28. A fluid bed according to claim 18, wherein the pulsing air supply is a capacity air pressure supply.

29. A fluid bed according to claim 18, wherein the conveyor is a vibrating table.

30. A fluid bed according to claim 18, wherein the conveyor is a belt conveyor.

31. A fluid bed according to claim 18, wherein the velocity of the pulsing air is 10 to 15 times as high as the velocity of the drying air.

32. A fluid bed according to claim 18, wherein the velocity of the pulsing air is about 20 m/sec. and the velocity of the drying air is about 1.5 m/sec.

* * * * *